United States Patent [19]

Matsushita et al.

[11] Patent Number: 4,984,022

[45] Date of Patent: Jan. 8, 1991

[54] IMAGE FORMING APPARATUS HAVING MEANS FOR ATTENUATING BIAS VOLTAGE OF THE DEVELOPING SLEEVE

[75] Inventors: Kouji Matsushita; Shizuo Yuge, both of Osaka, Japan

[73] Assignee: Minolta Camera Kabushiki Kaisha, Osaka, Japan

[21] Appl. No.: 275,505

[22] Filed: Nov. 23, 1988

[30] Foreign Application Priority Data

| | | | |
|---|---|---|---|
| Nov. 26, 1987 | [JP] | Japan | 62-298517 |
| Nov. 26, 1987 | [JP] | Japan | 62-298518 |
| Nov. 26, 1987 | [JP] | Japan | 62-298519 |

[51] Int. Cl.[5] ..... G03G 15/00

[52] U.S. Cl. ..... 355/246; 355/265; 355/268

[58] Field of Search ..... 355/208, 210, 246, 265, 355/268, 245; 430/100

[56] References Cited

U.S. PATENT DOCUMENTS

| | | | |
|---|---|---|---|
| 4,496,238 | 1/1985 | Tsukada et al. | 355/246 X |
| 4,631,559 | 12/1986 | Kaneko | 355/210 Y |
| 4,714,942 | 12/1987 | Nakanishi | 355/268 |
| 4,761,672 | 8/1988 | Parker et al. | 355/245 X |

FOREIGN PATENT DOCUMENTS

| | | | |
|---|---|---|---|
| 54-8538 | 1/1979 | Japan . | |
| 55-45059 | 3/1980 | Japan | 355/268 |
| 60-107052 | 6/1985 | Japan | 355/268 |
| 63-89878 | 4/1988 | Japan | 355/246 |

*Primary Examiner*—Joan H. Pendegrass

*Attorney, Agent, or Firm*—Burns, Doane, Swecker & Mathis

[57] ABSTRACT

An image forming apparatus including a photosensitive member, a developing sleeve for developing an electrostatic latent image formed on the photosensitive member by using a developer, and control means for controlling the application of bias voltage to the sleeve wherein the bias voltage is controlled so as to be maintained a predetermined time period after the image formation is interrupted.

16 Claims, 10 Drawing Sheets

IMAGE FORMING APPARATUS HAVING MEANS FOR ATTENUATING BIAS VOLTAGE OF THE DEVELOPING SLEEVE

BACKGROUND OF THE INVENTION

1. Field of the Invention

The present invention relates to an image forming apparatus for printers, copy machines and the like which supply toner from a developing device to an electrostatic latent image formed on the surface of a photosensitive member so as to form an image.

2. Description of the Prior Art

A printer a having the construction shown in FIG. 1 is provided as an example of a conventional image forming apparatus using an electrophotographic copy process.

In this image forming apparatus, a photosensitive drum 1 has arranged around its periphery along the direction of rotation (direction of arrow "Y") a charger 2, developing device 3, transfer charger 4, separation charger 5, jam detection sensor 6 comprising light emitting element 7 and photoreceptor 8, cleaning device 9, and main eraser 10.

An optical device 11 incorporating laser generator 12, lens 13 and mirror 14 is disposed above photosensitive drum 1. A light beam LB emitted from laser generator 12 is projected onto the surface of photosensitive drum 1 between charger 2 and developer 3 through lens 13 and mirror 14.

Developing device 3 is a commonly known device which uses a composite developer comprising a carrier and toner. Developing device 3 provides a rotatably or fixedly mounted developing sleeve 15 having a magnetic roller 16 disposed therein opposite said photosensitive drum 1. A specific bias voltage Vb is applied to said developing sleeve 15 from a power source 20. Toner and carrier which are mutually charged with opposite polarities are maintained in the state of a magnetic brush on the outer periphery of said developing sleeve 15.

In the image forming apparatus of the aforesaid construction, images are formed as described hereinafter.

Photosensitive drum 1 rotates in the direction of arrow "Y" and the surface thereof is uniformly charged by means of a discharge from charger 2, and a light beam LB emitted from laser generator 12 is projected so as to form an electrostatic latent image thereon.

Subsequently, the aforesaid electrostatic latent image is developed by toner supplied by a developing device 3 disposed opposite. As shown in FIG. 2, the developing operation is based on the voltage difference between the surface potential $V_o$ of the photosensitive drum 1 and the bias voltage $V_b$, wherein toner $T_o$ adheres only to the image portion 21 having a reduced potential induced by the projected light beam LB, while toner does not adhere to the background portion 22. On the other hand, the carrier on top of developing sleeve 15 is bound by the magnetic force of magnetic roller 16 and is thereby preserved without adhering to the surface of said photosensitive drum 1.

Toner $T_o$ on photosensitive drum 1 is then transferred to sheet "S" disposed opposite transfer charger 4, said sheet "S" is then separated from the surface of photosensitive drum 1 by separation charger 5, passes the fixing device (not shown in the drawings) and is discharged to a prescribed discharge portion (also not shown in the drawings). The surface of photosensitive drum 1 which has passed opposite separation charger 5 then passes opposite the jam detection sensor 6, and continues to rotate until opposite cleaning device 9 and eraser lamp 10 whereupon the residual toner and residual charge are removed respectively, thereby preparing said surface of photosensitive drum for a subsequent image forming process.

In the conventional image forming device, sheet "S" at times does not separate from the surface of the photosensitive drum 1 at the separation portion, but rather continues to be carried in a state wherein it remains covering the surface of said photosensitive drum 1. If the aforesaid situation is not prevented, photosensitive drum 1, cleaning device 9 and eraser lamp 10 will be damaged, and removing the paper jam is extremely difficult.

Therefore, the power supplied to charger 2 is interrupted when sheet "S" is detected by jam detection sensor 6, and the drive unit (not shown in the drawing) which drives photosensitive drum 1 is immediately stopped, as shown in FIG. 7. Further, switch 17 in power unit 20 is switched from developing bias power source 18 to ground 19, the bias voltage of developing sleeve 15 drops to nearly 0 V, and the operator is safe from electrical shock even if he should touch the developing sleeve 15 when servicing the paper jam.

The aforesaid process does not only occur when the sheet "S" does not separate from the photosensitive drum in the separation portion thereby producing a paper jam. That is, the drive unit is stopped and the power unit switched also when a jam occurs after the sheet "S" is transported out of the separation portion and into the transport portion, when the charging means leaks or is disconnected, when the main eraser is switched OFF, and when the operator opens the cover of the printer or copy machine to access the interior of said machine.

However, when switch 17 is switched, the developing bias $V_b$ simultaneously drops to nearly 0 V, while electric potential maintained in the region "X" on the surface of photosensitive drum 1 between charger 2 and developing device 3 does not drop immediately, but rather tends to decrease slowly.

However, photosensitive drum 1 continues to rotate due to the influence of inertia even after the drive unit is stopped. Thus, when a jam occurs while a charge is maintained in the region "X" of photosensitive drum 1, each time said charged portion 22 passes opposite the developing sleeve 15 some carrier is released from the restraint of magnetic roller 16 thereby separating from the developing sleeve 15 and adhering to the charged portion 22 due to the electrical force produced by the difference in potential between the surface potential $V_o'$ of the charged portion and the developing bias voltage $V_b$ (which is approximately 0 V), as shown in FIG. 4.

There is also a type of image forming apparatus divided into dual vertical units wherein a developing sleeve 15 travels along the outer periphery of a photosensitive drum 1 whenever the top unit is opened relative to the bottom unit. When the top unit is opened for paper jam processing, the carrier is lost from the developing sleeve 15 in the manner previously described.

A disadvantage obtains in that the carrier is therefore removed from the developing sleeve 15 each time a jam occurs, and since said carrier cannot be gradually replenished, unlike the toner, the longevity of said composite developer is shortened.

Further, following the completion of the jam processing, a surface charge remains on the upstream side of the image portion of the photosensitive drum 1, and the same aforesaid problem occurs each time the photosensitive drum 1 is again rotated after a temporary halt in said rotation.

The disadvantage of consumption of a carrier incorporated in bicomponent developer with each paper jam has been described above. However, this disadvantage is not limited only to bicomponent developers, but is also relevant to monocomponent developers as well. That is, adhesion of the monocomponent developer to the surface of the photosensitive drum whenever a jam occurs also wastes toner.

SUMMARY OF THE INVENTION

Accordingly, a main object of the present invention is to provide a superior image forming apparatus which is capable of eliminating the aforesaid disadvantages.

A further object of the present invention is to prevent toner and carrier from being supplied from the developing sleeve to the photosensitive drum when the connection between said developing sleeve and the bias voltage power unit is interrupted due to a jam or other problem.

These and other objects are attained by, in one method, providing a means capable of attenuating the impressed voltage of the developing sleeve when the voltage applied to said developing sleeve is interrupted and having the same dark decay characteristics as the photosensitive member, said means being provided to the means for applying a voltage to the developing sleeve.

Another method pertains to halting the rotational drive of the photosensitive drum which maintains a charge on the surface thereof, reducing the surface voltage of said photosensitive drum to a specific level by means of dark decay characteristics, subsequently maintaining a developing bias voltage applied to the developing sleeve and thereafter reducing the potential to near zero.

A further method pertains to the input of a signal to halt the operation of the charging means, subsequently moving at least a point on the photosensitive drum from the charging position to the developing position, and thereafter halting the rotational drive of said photosensitive drum and reducing the developing bias voltage to near zero.

BRIEF DESCRIPTION OF THE DRAWINGS

These and other objects or features of the present invention will become apparent from the following description of a preferred embodiment(s) thereof taken in conjunction with the accompanying drawings, in which.

In the following description, like parts are designated by like reference numbers throughout the several drawings.

DETAILED DESCRIPTION OF THE PREFERRED EMBODIMENT

The present invention is described hereinafter with reference to the accompanying drawings.

Figure 5:
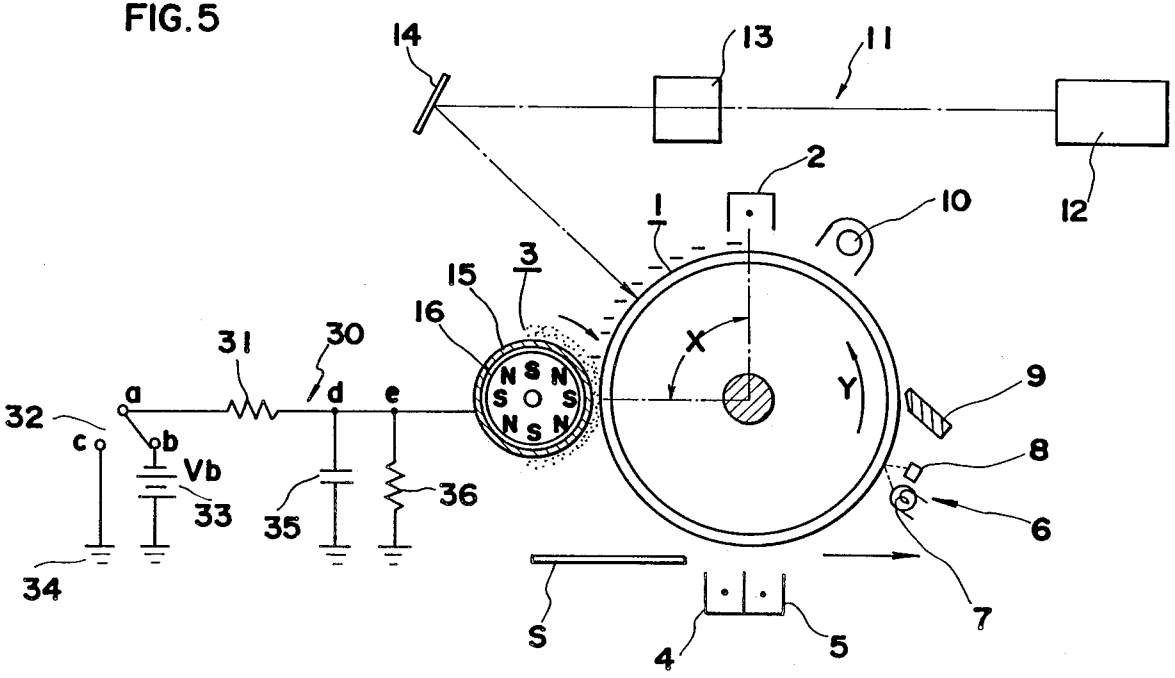
FIG. 5 is a schematic cross section view showing the construction of the image forming apparatus of the present invention.

FIG. 5 shows a schematic section view of the image forming apparatus of the present invention. The apparatus is substantially the same as the image forming apparatus shown in FIG. 1 with the exception that the power unit 30 which applies power to developing sleeve 15 alone is different. Thus, like parts are designated by like numbers and the description is abbreviated.

Power unit 30 is connected to developing sleeve 15 at contact "a" via resistor 31, said contact "a" being selectively connected to contact "b" or contact "c" via switch 32. Contact "b" is connected to ground 34 via developing power unit 33, and contact "c" is directly connected to said ground 34. Developing sleeve 15 and resistor 31 have interposed therebetween contacts "d" and "e" which are also connected to ground 34 through condenser 35 and resistor 36 respectively.

Switch 32 is switched by a signal output by a control unit not shown in the drawing, and during the developing process is connected to contact "b" so as to apply a specified developing bias voltage $V_b$ from the developing bias power source 33 to developing sleeve 15.

When a paper jam or other problem occurs, switch 32 is switched to contact "c" and the charge accumulated by developing sleeve 15 is discharged by condenser 35 and resistors 31 and 36 with definite decay characteristics and a set time constant, and moves to a normal state after a transition period. The aforesaid decay characteristics follow a similar trend to that of photosensitive drum 1 decay characteristics indicated by the solid line in FIG. 6 (said trend being expressed by the dotted line in FIG. 6).

When a sheet (S) jams during the developing process and said jam is detected by jam detection sensor 6, switch 32 in the aforesaid power unit 30 is switched from contact "b" to contact "c" by means of a signal output by a control device not shown in the drawing.

Figure 6:
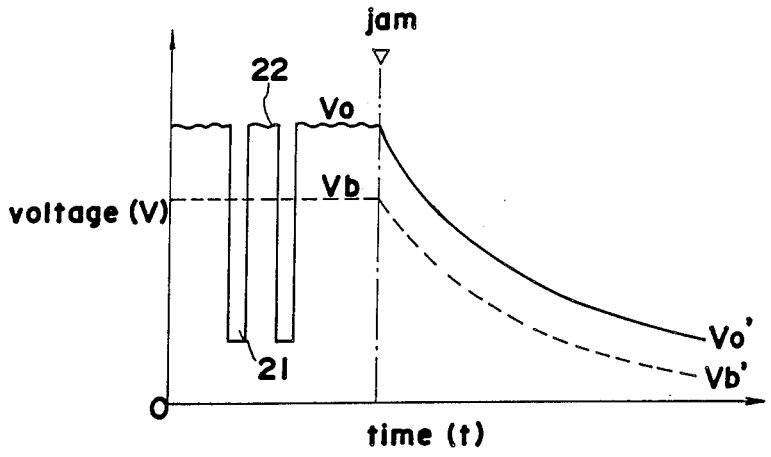
FIG. 6 is an illustration showing the surface potential decay characteristics for the photosensitive drum and developing sleeve of the present invention.

The aforesaid switch results in the surface potential of photosensitive drum 1 in the region "X" opposite to and upstream of developing unit 3 decays along the solid line indicated by $V_o'$ in FIG. 6. On the other hand, the developing bias voltage $V_b$ decays along the dotted line indicated by $V_b'$ in FIG. 6, and the difference in electric potential between photosensitive drum 1 and developing sleeve 15 is maintained virtually constant at the safe level as during the developing process.

Accordingly, the carrier maintained on developing sleeve 15 does not adhere to the surface of photosensitive drum 1 even in a configuration wherein photosensitive drum 1 continues to rotate after a jam occurs due to inertia and rotates while the jam is removed, or developing sleeve 15 travels along the outer periphery of photosensitive drum 1 whenever the top unit of a image forming apparatus divided into dual vertical units is opened, or even when the temporarily halted photosensitive drum 1 begins to rotate again after jam processing is completed. At the same time, adhesion of the toner on the developing sleeve 15 to the surface of photosensitive drum 1 poses no problem from a practical standpoint since said toner can be gradually resupplied thereto.

Figure 7:
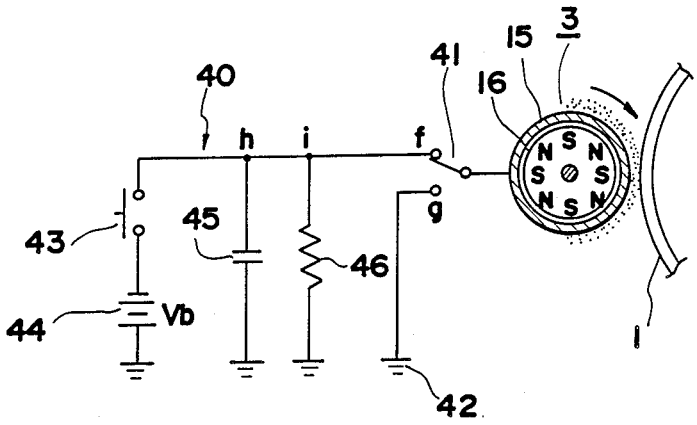
FIGS. 7, 8 and 9 are circuit diagrams of the power unit showing other embodiments of the present invention.
Figure 8:
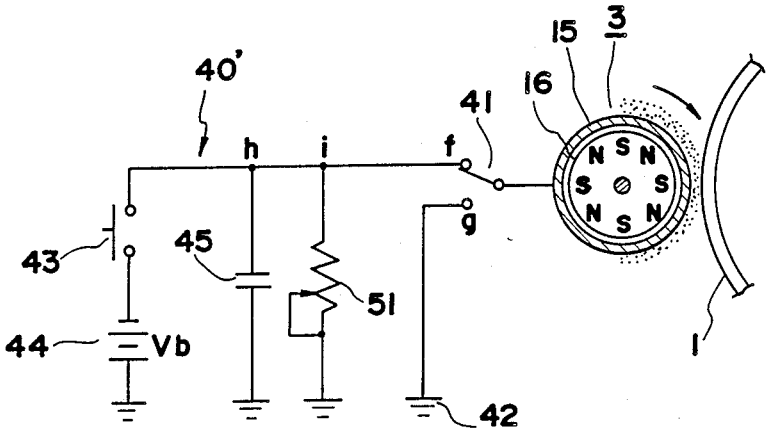
Figure 9:
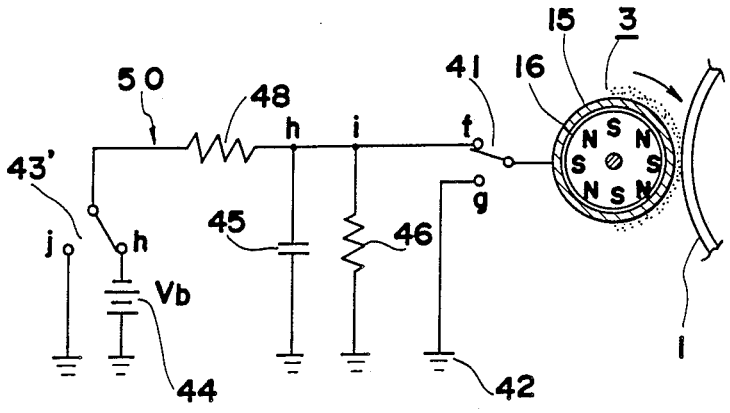

Power unit 30 is not limited to the aforesaid embodiment and also may be configured as shown in FIGS. 7, 8 and 9.

Power unit 40, shown in FIG. 7, has a switch 41 connected to developing sleeve 15 which is switchable between contact "f" and contact "g." Contact "f" is connected to ground 42 via switch 43 and developing bias power source 44, while contact "g" is directly connected to said ground 42. Further, contact "f" and switch 43 have interposed therebetween contacts "h" and "i," one terminal of said contacts being connected to ground 42 and the other terminals being connected to condenser 45 and resistor 46 respectively.

The decay characteristics determined by the aforesaid condenser 45 and like components are virtually identical to the dark decay characteristics as photosensitive drum 1 of the previous embodiment.

Switch 41 is switched by opening the front cover which opens the front of the image forming apparatus. When the front cover is closed, said switch 41 is connected to contact "f;" when said front cover is open, switch 41 is switched so as to be connected to contact "g."

On the other hand, switch 43 controls the ON-OFF status by a signal output from a control unit (not shown in the drawing). When a paper jam is detected, said switch 43 is in the OFF state, and during the developing process said switch 43 is in the ON state.

Figure 10:
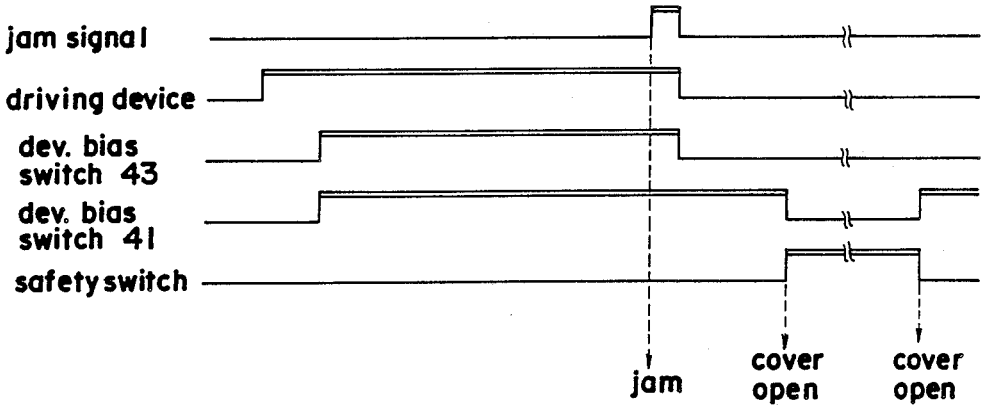
FIG. 10 is a timing chart showing the ON-OFF timing for each switch in the circuits shown in FIGS. 7 and 8.

The switch timing of said switches 41 and 43 is shown in FIG. 10.

When a paper jam is detected during the developing process, switch 43 in the aforesaid power unit 40 is switched OFF, and the developing bias voltage $V_b$ decays in accordance with decay characteristics which are identical to those of the dark decay characteristics of photosensitive drum 1.

When the front cover is opened to remove the paper jam in mid process, switch 41 connection is switched to contact "g," thereby grounding the developing sleeve 15 and dissipating the charge therefrom. When the front cover is subsequently closed, switch 41 is again switched to contact "f," and the charge accumulated by condenser 45 again decays with the same characteristics as the dark decay characteristics of photosensitive drum 1.

Power unit 40', shown in FIG. 8, replaces resistor 46 of power unit 40 (FIG. 7) with a variable resistor 51. When the decay characteristics of photosensitive drum 1 are irregular, or when the decay characteristics are altered due to environmental conditions, in each instance, a time constant consistent with said decay characteristics can be selected by adjusting the aforesaid variable resistor 51.

Power unit 50, shown in FIG. 9, interposes a resistor 48 and switch 43' between contact "h" and developing bias voltage power source 44 (FIG. 7), said switch 43' being switchable between contact "k " which is connected to developing bias power source 44 and contact "j" which is connected to ground 42.

When switch 43' in power unit 50 is connected to contact "j," the decay characteristics determined by the time constant set by condenser 45 and resistors 46 and 48 is identical to the dark decay characteristics of photosensitive drum 1, just as in the aforesaid power unit 40.

Therefore, when switch 43' is switched from contact "h" to contact "j" when a jam occurs, the electrical potential of developing sleeve 15 decays with the same decay characteristics as photosensitive drum 1. In addition, when the front cover is opened, switch 41 switches from contact "f" to contact "g" and the surface potential of developing sleeve 15 drops to 0 V to maintain safety.

Although switch 41 in the aforesaid power unit is switched ON-OFF by opening and closing the front cover, activation of said switch is not limited to this mode alone, but rather may also be switched OFF by opening the top unit of an image forming apparatus divided into dual vertical units.

The above description explains how developing bias decays in correspondence to photosensitive drum 1 dark decay characteristics when the developing sleeve 15 power unit is switched OFF in the aforesaid embodiment.

Another embodiment of the invention is described hereinafter.

Figure 1:
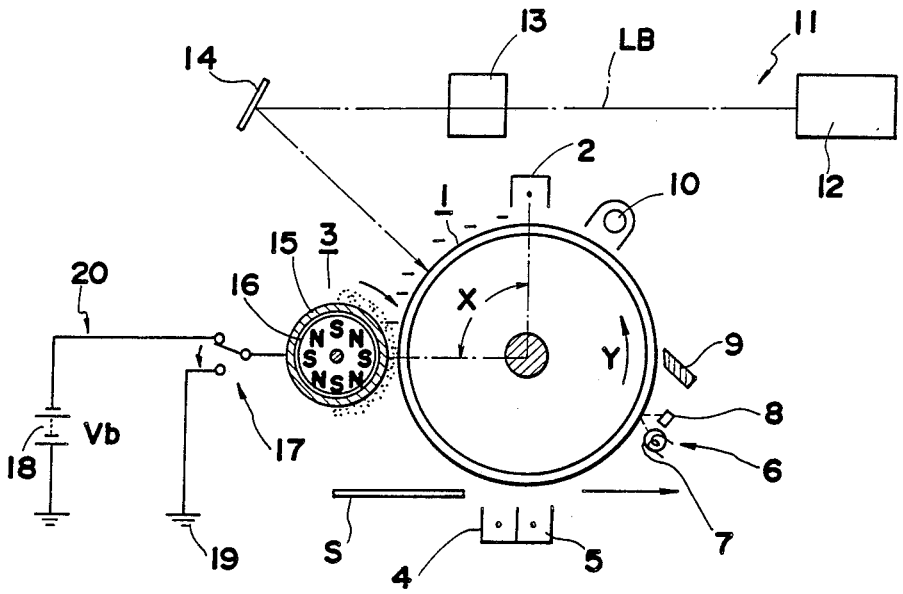
FIG.1 PRIOR ART
FIG. 1 is a schematic cross section view of a conventional image forming apparatus.
Figure 2:
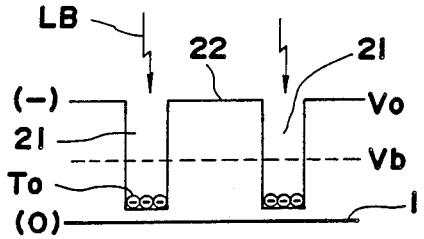
FIG. 2 is an explanatory illustration of an electrostatic latent image being developed by toner.
Figure 3:
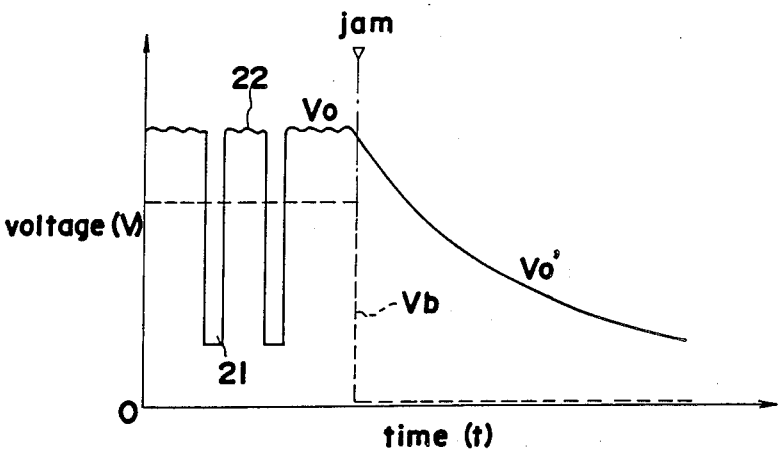
FIG. 3 is an illustration showing surface potential decay characteristics for the photosensitive drum and developing sleeve in a conventional image forming apparatus.
Figure 4:
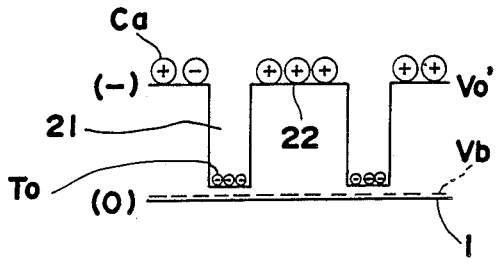
FIG. 4 is an explanatory illustration of carrier adhesion on the surface of the photosensitive member.
Figure 11:
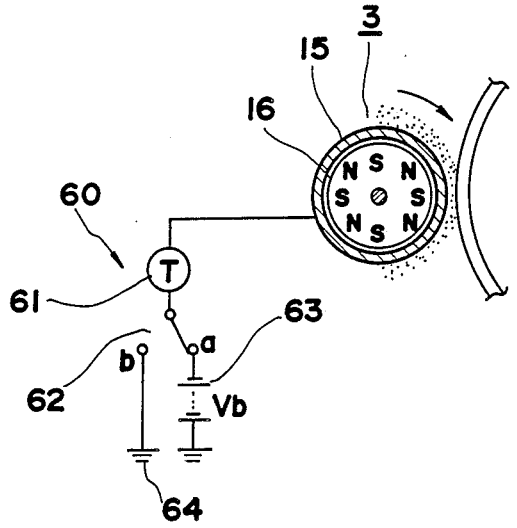
FIG. 11 is a power unit circuit diagram showing still another embodiment of the present invention.

FIG. 11 shows another power unit 60 which applies current to developing sleeve 15 of the conventional image forming apparatus of FIG. 1.

In power unit 60, developing sleeve 15 is connected to switch 62 via a timer 61, said switch 62 being switchable to contact "a" and contact "b." Contact "a" is connected to ground 64 via the developing bias power source 63. When switch 62 is switched so as to make contact with contact "a," a specific bias voltage $V_b$ from the developing bias power source 63 is applied to developing sleeve 15. Further, contact "b" is directly connected to ground 64.

The aforesaid switch 62 is controlled by timer 61 which is in turn controlled by signals from a control unit not shown in the drawing. Timer 61 is connected to contact "a" while it is counting, and when the timer incrementation has completed it switches to connection with contact "b."

The timing value $T_{o1}$ for the aforesaid timer 61 is set as follows.

Figure 12:
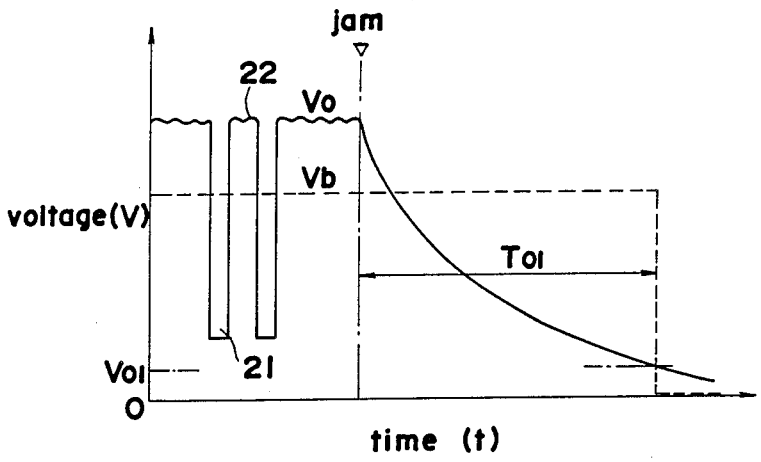
FIG. 12 is an illustration of the surface potential decay characteristics for the photosensitive member and developing sleeve of the apparatus shown in FIG. 11.

When a jam or other problem occurs during the image forming operation, the surface potential maintained on the photosensitive drum 1 is discharged as per the decay characteristics described by the solid line in FIG. 12. Then, the aforesaid timer value $T_{o1}$ is designated the timer required for the surface potential $V_o$ of photosensitive drum 1 to be reduced to a specific level $V_{o1}$.

Therefore, when sheet "S" jams and is detected by jam detection sensor 6 during the developing process, timer 61 is started via a signal output from the control unit, and the developing bias $V_b$ is maintained in a state comparable to that which obtains during the developing process throughout the operation of said timer 61. On the other hand, the charge on region "X" on the surface of photosensitive drum 1 gradually drops as indicated by the solid line in FIG. 12.

The result of this process is that the surface potential of photosensitive drum 1 immediately after the jam occurs is higher than developing bias $V_b$, but thereafter during the timer counting operation, developing bias $V_b$ is higher than the surface potential of photosensitive drum 1, and transference of the carrier maintained on the surface of developing sleeve 15 to the photosensitive drum is prevented. Although toner is transferred from the surface of developing sleeve 15 to the photosensitive drum 1 due to its charge which is the opposite polarity of the carrier, this transference poses no problem from a practical standpoint since said toner can be suitably replenished.

Figure 14:
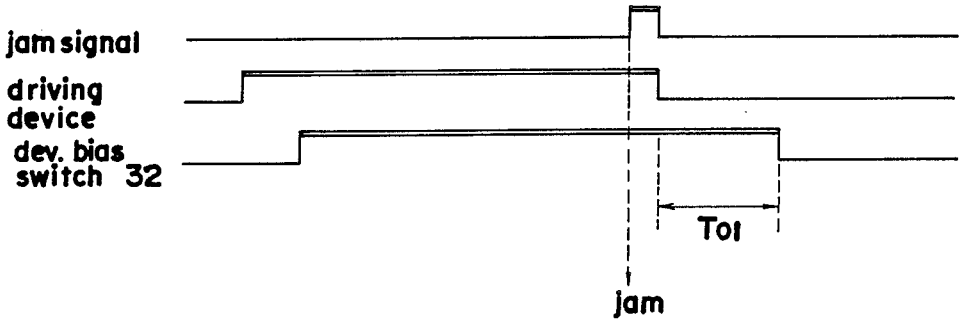
FIG. 14 is a timing chart showing the ON-OFF timing of each switch of the control circuit shown in FIG. 11.

When timer 61 completes incrementing, switch 62 is switched to contact "b" to directly connect developing sleeve 15 to ground 64, whereby the surface potential of said developing sleeve drops to near 0 V. The switch timing of said switch 62 is shown in FIG. 14.

However, at that moment the surface voltage of photosensitive drum 1 drops to the vicinity of 0 V, and because there is no difference in potential between the surface voltage of photosensitive drum 1 and that of developing sleeve 15, the carrier is pulled by the magnetic force of magnetic roller 16 so as to be maintained on the surface of said developing sleeve 15 without being transferred to the surface of photosensitive drum 1.

During the counting operation by timer 61 in the aforesaid embodiment, the bias voltage $V_b$ of developing sleeve 15 is maintained in a state identical to that during the developing process, and thereafter abruptly drops to near 0 V, but the reduction in said developing sleeve bias is not limited to this mode, and may be reduced gradually.

Figure 13:
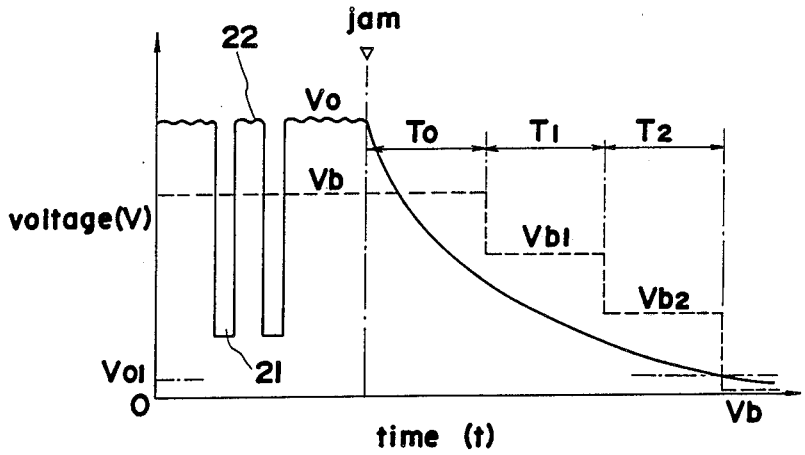
FIG. 13 is an illustration showing the surface potential decay characteristics for the photosensitive member and developing sleeve achieved by another power unit in another embodiment of the present invention.

More specifically, the output of developing bias power source 63 may be made variable conforming to the dark decay characteristics of photosensitive drum 1, as shown in FIG. 13, timers T1, T2 and T3 are sequentially set when a jam or other problem occurs, developing bias voltages $V_b$, $V_{b1}$ and $V_{b2}$ are reduced in order during operation of the aforesaid respective timers, finally dropping to near 0 V at the moment the surface voltage of photosensitive drum 1 drops to a specific level $V_{o1}$ after the completion of timer T2.

In such a case, there is little difference in surface potential between the photosensitive drum 1 and developing sleeve 15, and toner consumption can be prevented.

Further, the setting of each timer value $T_{o1}$, $T_o$, $T_1$ and $T_2$ is freely settable and adjustable according to conditions of photosensitive drum dark decay characteristics, heat, humidity and the like.

Operation of the power unit of the aforesaid embodiment during paper jams which has been described above is not limited to paper jam alone, but rather also can be implemented when other problems arise to halt the drive of photosensitive drum 1 during the developing process to prevent consumption of the carrier.

A still further embodiment is described hereinafter.

Figure 15:
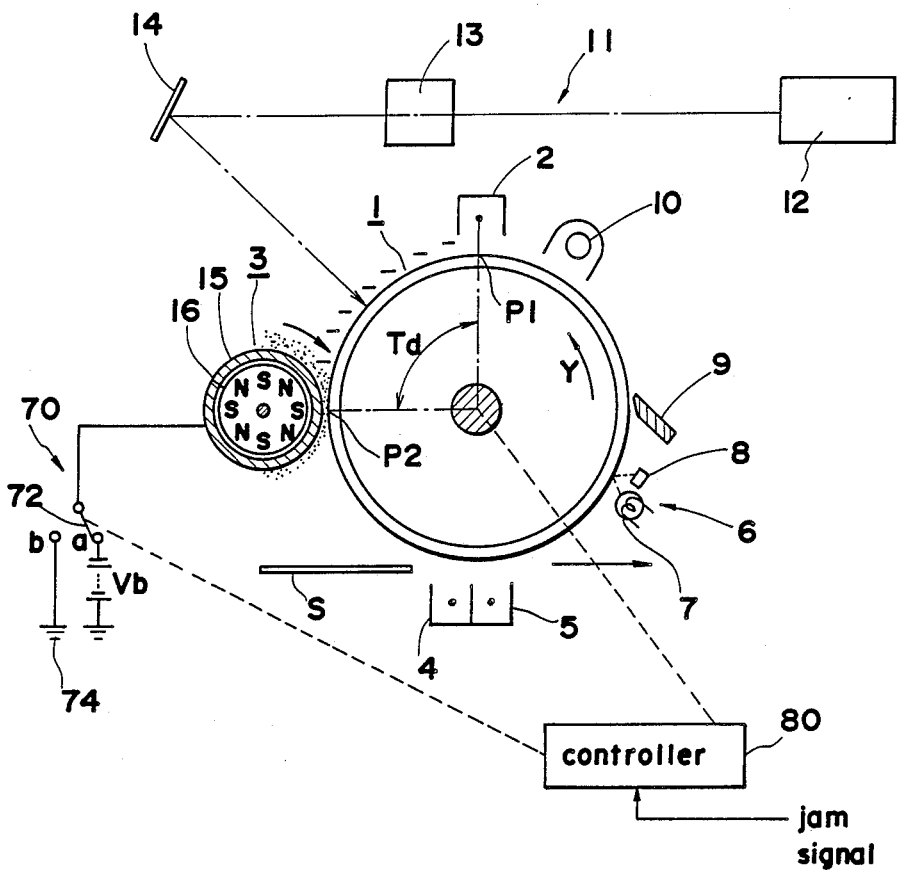
FIG. 15 is a schematic cross section view of still another embodiment of the present invention.

FIG. 15 shows a schematic cross section view of the image forming apparatus of the present embodiment. The apparatus is substantially the same as that shown in FIG. 1 with the exception that the control of the photosensitive drum drive when a jam occurs is different. Item 80 in FIG. 15 is a control unit which controls the drive of photosensitive drum 1 and the switching of switch 72 of power unit 70. Control unit 80 has provided therein an internal timer T. Power unit 70 is identical to power unit 20 of FIG. 1.

Figure 16:
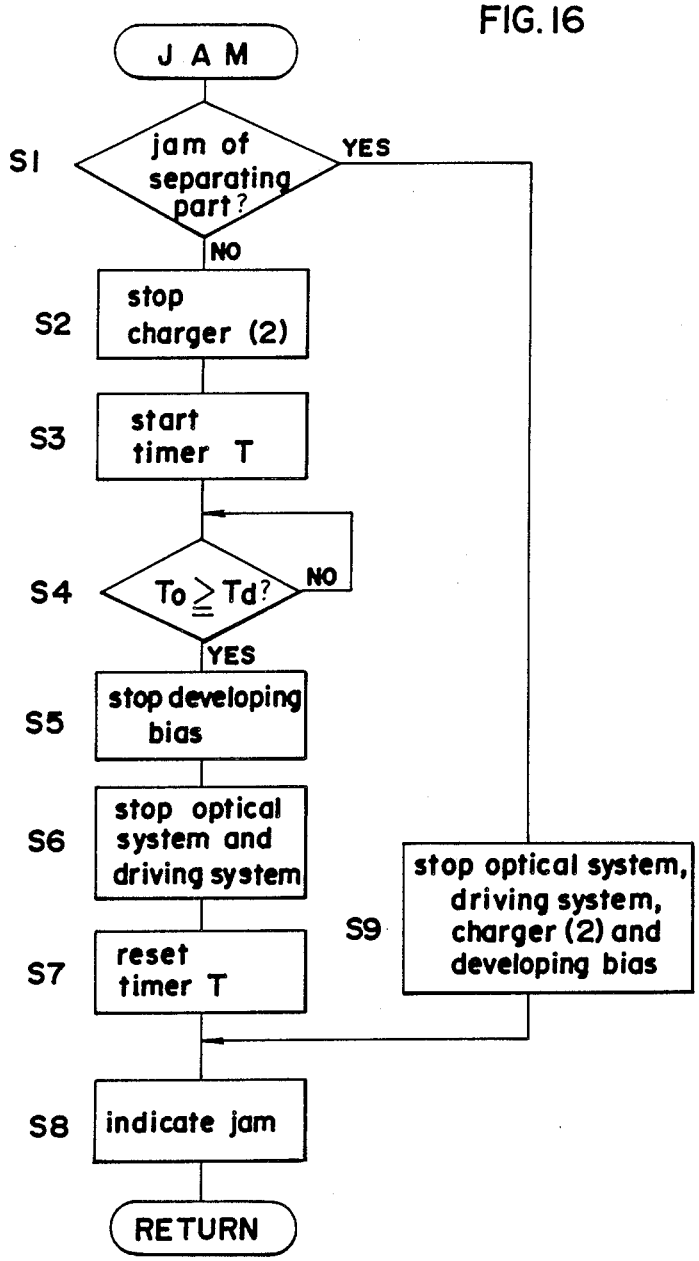
FIG. 16 is a flow chart showing the operation control of the device shown in FIG. 15 which occurs during paper jams.

A description follows hereinafter of the control operation when a jam occurs in the aforesaid image forming apparatus with reference to the flow chart in FIG. 16.

First, when a jam detection signal, which is one of the HALT operation signals, is input to control unit 80, a determination is made in step S1 as to whether or not the jam originates in the separation portion. That is, the jam detection sensor 6 determines whether or not a paper jam has occurred when the separation charger is unsuccessful in separating the sheet S from the photosensitive drum 1. If a jam has occurred in the separation portion, the routine continues to step S9 and the drive systems (not shown in the drawing) for the optical unit 11 and photosensitive drum 1 are stopped, supply of power to charger 2 and developing sleeve 15 are interrupted, and in step S8 a jam message is displayed in the display portion (not shown in the drawing) of the image forming apparatus. The power interrupt operation for power supplied to developing sleeve 15 is accomplished by switching the connection of switch 72 in power unit 70 from contact "a," to which it is connected during the image forming process, to contact "b."

On the other hand, when it is determined that the paper jam has not occurred in the separation portion, then in step S2 the supply of power to charger 2 is interrupted, the charging of the surface of photosensitive drum 1 is stopped.

Next, timer T is started in step S3, and the timer counts in step S4. When the counting value becomes greater than the time Td required for a point on the photosensitive drum 1 to travel from the charging position P1 opposite charger 2 to the developing position P2 opposite developing sleeve 15, the routine progresses to step S5 where switch 72 is switched from contact "a" to contact "b" and the surface voltage of developing sleeve 15 drops to near 0 V. That is, before charger 2 is stopped, the charged portion passes completely by developing position P2 so that the uncharged portion is opposite developing sleeve 15, and the developing bias voltage $V_b$ drops to near 0 V.

Accordingly, during the aforesaid time Td, toner adheres to the electrostatic latent image formed on the surface of photosensitive drum 1, and although a normal image formation operation continues thereafter, carrier from developing sleeve 15 does not adhere to photosensitive drum 1. Further, the aforesaid toner and carrier are maintained on the surface of the developing sleeve 15 without transfer of said toner and carrier to the photosensitive drum 1 because before charger 2 is stopped the portion further upstream from charging position P1 in the direction of rotation of photosensitive drum 1 reaches developing position P2, and the bias voltage $V_b$ of developing sleeve 15 has already dropped to near 0 V by this moment and the charge on the surface of photosensitive drum 1 has not been maintained.

Continuing, in step S6, the optical and drive systems are stopped, and in step S7 timer T is reset, after which a jam message is displayed on the display portion in step S8 and the routine returns.

In the aforesaid embodiment, the developing bias voltage $V_b$ drops to near 0 V by the moment at which the timer value $T_o$ of timer T becomes greater than time Td. However, the aforesaid timer value is not limited this mode and may be greater than the time Td; the length of said timer value may be altered according to differences in the image forming process, i.e., standard developing method or reverse developing method.

The above description has mainly concerned the transference of the carrier contained in a bicomponent developer from the developing sleeve to the photosensitive drum in the aforesaid embodiments of the present invention. However, the present invention is not limited in application to bicomponent developers only. That is, when a monocomponent developer is used in a standard developing method, an electrical force is generated due to the difference in potential caused by stopping the devices due to a paper jam during the image forming process, and the monocomponent developer is transferred from the developing sleeve to the photosensitive drum. The thus transferred monocomponent developer can be disposed of as waste material. Therefore, the present invention can effectively prevent wasteful adhesion of the monocomponent developer on the photosensitive drum.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus using an electrophotographic copy process comprising:

a developing sleeve disposed so as to confront a photosensitive member and carrying a developer on an outer periphery thereof;

a voltage source applying a specific bias voltage to said developing sleeve;

interrupting means for interrupting image formation; and means for attenuating the bias voltage of said developing sleeve according to decay characteristics substantially similar to dark decay characteristics of said photosensitive member when the image formation is interrupted by said interrupting means.

2. An image forming apparatus of claim 1, wherein said developer is a composite developer with carrier and toner.

3. An image forming apparatus of claim 1, wherein said developer is a monocomponent developer.

4. An image forming apparatus of claim 1, wherein said bias voltage has the same polarity as the charges to the photosensitive member.

5. An image forming apparatus of claim 1, wherein said attenuating means includes a circuit having a condenser and a resister and being connected between the voltage source and the developing sleeve.

6. An image forming apparatus of claim 1, further comprising:

means for grounding said developing sleeve when a front cover for covering the image forming apparatus is opened.

7. An image forming apparatus using an electrophotographic copy process comprising:

a developing sleeve disposed so as to confront a photosensitive member and carrying a developer on an outer periphery thereof;

a voltage source applying a specific bias voltage to said developing sleeve;

a charging device disposed in confronting relationship to the photosensitive member and upstream from said developing sleeve and charging said photosensitive member with charges for an image formation;

interrupting means for interrupting image formation; and means, when the image formation is interrupted, for preventing application of the bias voltage after surface voltage of said photosensitive member has been reduced to a specific level according to dark decay characteristics of said photosensitive member.

8. An image forming apparatus of claim 7, wherein said developer is a composite developer with carrier and toner.

9. An image forming apparatus of claim 7, wherein said developer is a monocomponent developer.

10. An image forming apparatus of claim 7, further comprising:

means for reducing the bias voltage stepwise between the time of interruption of the image formation and the time of stopping the application of the bias voltage.

11. An image forming apparatus of claim 7, wherein said bias voltage has the same polarity as the charges to the photosensitive member.

12. An image forming apparatus using an electrophotographic copy process comprising:

a developing sleeve disposed so as to confront a photosensitive member and carrying a developer on an outer periphery thereto;

a voltage source applying a specific bias voltage to said developing sleeve;

a charging device disposed in confronting relationship to the photosensitive member and upstream from said developing sleeve and charging said photosensitive member with charges for an image formation;

interruption means for interrupting the image formation in accordance with a first defect caused by a paper jam in a separation portion at which a paper is removed from the photosensitive member and a second defect caused by any factor except the paper jam in the separation portion;

a driving means for forcibly driving the photosensitive member during a predetermined time period after the image formation is interrupted so that a non-charged portion of the photosensitive member confronts the developing sleeve;

a maintaining means for maintaining the application of the bias voltage during said predetermined time period; and a control means for controlling said maintaining means and said driving means to be nonoperational when the image formation is interrupted by the first defect, and for controlling said maintaining means and said driving means to be operational when the image formation is interrupted by the second defect.

13. An image forming apparatus of claim 12, wherein said developer is a composite developer with carrier and toner.

14. An image forming apparatus of claim 12, wherein said developer is a monocomponent developer.

15. An image forming apparatus of claim 12, wherein said bias voltage has the same polarity as the charges to the photosensitive member.

16. An image forming apparatus using an electrophotographic copy process comprising:

a developing sleeve disposed so as to confront a photosensitive member and carrying a developer on an outer periphery thereof;

a voltage source applying a specific bias voltage to said developing sleeve;

interrupting means for interrupting image formation; and means for attenuating the bias voltage of said developing sleeve with maintaining a predetermined potential difference from the photosensitive member voltage decreasing according to dark decay characteristics when the image formation is interrupted by said interrupting means.

* * * * *